US005517813A

United States Patent [19]

Klundt

[11] Patent Number: 5,517,813

[45] Date of Patent: May 21, 1996

[54] METHOD FOR FORMING TWISTED CORD ELEMENTS

[75] Inventor: Kalvin Klundt, LaGrange, Ky.

[73] Assignee: K & A Design, Inc., Louisville, Ky.

[21] Appl. No.: 161,669

[22] Filed: Dec. 6, 1993

[51] Int. Cl.[6] ..... B21F 29/00; B21F 43/00

[52] U.S. Cl. ..... 57/25; 57/26; 140/49

[58] Field of Search ..... 57/25, 26, 27; 29/160.6; 140/49

[56] References Cited

U.S. PATENT DOCUMENTS

| | | | |
|---|---|---|---|
| 272,757 | 2/1883 | Parker | 57/25 |
| 433,855 | 8/1890 | Ellis . | |
| 605,930 | 6/1898 | Stauffer | 52/26 |
| 1,430,519 | 9/1922 | Cattoor | 57/27 |
| 2,326,631 | 8/1943 | Corda | 57/26 |
| 2,363,404 | 11/1944 | Drake et al. | 57/26 |
| 2,935,838 | 5/1960 | Briscoe | 57/26 |
| 4,369,690 | 1/1983 | Sapkus | 87/33 |
| 4,580,585 | 4/1986 | Sapkus | 132/9 |
| 4,582,074 | 4/1986 | Schwager et al. | 132/9 |
| 4,583,561 | 4/1986 | Larsson | 132/9 |

*Primary Examiner*—William Stryjewski

[57] ABSTRACT

A method for twisting an elongated cord member to form a permanently twisted cord element is preferably performed utilizing an apparatus which includes first and second end units, first and second securing and twisting assemblies for securing opposite end portions of the cord member to the first end unit and for thereafter axially rotating the opposite end portions of the cord member. The apparatus further includes an intermediate securing assembly on the second end unit for selectively rotatably and non-rotatably securing the cord member to the second end unit at an intermediate point in the cord member. The apparatus operative in the method by securing the opposite end portions of the cord member to the first end unit, securing the cord member to the intermediate securing assembly on the second end unit, axially rotating the opposite end portions of the cord member while maintaining the intermediate point of the cord member in stationary relation and then operating the intermediate securing assembly to allow the intermediate point to rotate so that opposite sections of the cord member are twisted about one another.

1 Claim, 5 Drawing Sheets

METHOD FOR FORMING TWISTED CORD ELEMENTS

BACKGROUND AND SUMMARY OF INVENTION

The instant invention relates to arts and crafts apparatus for children and more particularly to an apparatus for forming twisted cord elements which can thereafter be effectively utilized for forming bracelets, necklaces, and the like.

Various types of twisting apparatus have been heretofore available, including the devices disclosed in the U.S. Pat. Nos. to Sapkus, No. 4,369,690 and 4,580,585; Schwager et al, No. 4,582,074; Larson, No. 4,583,561. However, the heretofore available apparatus disclosed in these patents are specifically directed toward twisting, twining, or braiding human hair rather than twisting one or more elongated cord members to form twisted cord elements, and therefore, they are believed to be of only general interest with respect to the subject invention. The U.S. Pat. No. to Ellis, No. 433,855, which discloses a technique for manufacturing twine representing the only other relevant prior art, known to the applicant, is also believed to be of only general interest with respect to the subject invention. Specifically, the Ellis device bears very little similarity to the operational arrangement or structural features of the apparatus of the subject invention.

The instant invention provides an effective apparatus which can be utilized by a young child for forming various twisted cord elements from one or more elongated cord members so that the twisted cord elements can be formed into various items, including bracelets, necklaces, etc. More specifically, the instant invention provides an effective and easy to use twisting apparatus which is operative for individually twisting opposite end portions of an elongated cord member and for then allowing the opposite end portions of the cord member to be twisted together to form a finished twisted cord element. More specifically, the instant invention provides and apparatus for making a twisted cord element from an elongated cord member comprising first and second end units which are adapted to be supported on a supporting surface so that at least one of the end units is slidable toward and away from the other end unit. The apparatus further comprises spaced first and second securing assemblies for releasably securing opposite first and second end portions of the cord member to the first end unit at spaced location thereon. The apparatus still further includes an intermediate cord member securing assembly on the second end unit for releasably securing the cord member to the second end unit at an intermediate point in the cord member so as to define opposite first and second cord member sections which are of substantially equal length and which extend between the first and second end units. The intermediate cord member securing assembly on the second end unit is selectively operable for rotatably or non-rotatably securing the intermediate point of the cord member to the second end unit, and the apparatus further includes a twisting mechanism for axially twisting each of the first and second cord member sections in the same direction of rotation. Accordingly, by actually twisting each of the first and second cord member sections with the twisting mechanism while maintaining the intermediate point of the cord member in non-rotatable relation, and by thereafter releasing the intermediate point of the cord member so that the opposite sections of the cord member are twisted about one another, it is possible to form a twisted cord element which retains its twist even after it is removed from the apparatus.

Further, by thereafter securing the free opposite end portions of the twisted cord element together, such as by knotting them together, it is possible to permanently retain the twisted cord element in a twined or twisted configuration so that it can be formed into an article, such as an item of jewelry, e.g. a bracelet or a necklace. The twisting mechanism for axially twisting the first and second end portions is preferably operative for simultaneously twisting the first and second end sections of the cord member by equal amounts, and it preferably includes a trigger element which is squeezable for simultaneously twisting the first and second end sections. Further, one of the first and second units is preferably adapted to be retained in a predetermined position on a supporting surface, such as one in which it engages an edge of a table surface, and the other end unit is preferably adapted so that it is slidable toward the secured end unit for moving the end units together as the cord members are twisted. The means for releasably securing the cord member to the second end unit preferably comprises a hook element for releasably engaging the cord member at the intermediate point in the extent thereof, and the hook element is preferably secured to the second end unit so that it is selectively rotatable or non-rotatable relative thereto. The means for releasably securing the cord member to the second end unit preferably includes a depressible release button for releasing the hook element so that it is free to rotate once the opposite sections of the cord member have been properly twisted.

It has been found that the apparatus and method of the subject invention can be effectively utilized for forming twisting cord elements of various types which can then be utilized for forming various articles, such as necklaces, bracelets, etc. In this regard, the cord member utilized in the apparatus can comprise either a single strand cord member or a plurality of individual strands, depending on the desired appearance and construction of the finished twisted cord element. It is also possible to assemble items, such as beads or the like, on the cord member before the cord member is twisted in the apparatus so that the items assembled on the cord member are incorporated in the finished twisted cord element. In any event, the apparatus provides an effective means for twisting a cord member so that the cord member remains in a twisted disposition even after it is removed from the apparatus. In this regard, by first axially twisting the first and second sections of the cord member in the same direction while retaining the immediate point of the cord member in non-rotatable relation, and by thereafter allowing the intermediate point of the cord member to rotate or twist the first and second portions of the cord member together it is possible to form a twisted cord element which retains its twisted configuration even after it is removed from the apparatus. Further, the apparatus is adapted so that it can be effectively utilized by a young child who might not have sufficient manual dexterity to operate a more complicated twisting or twining apparatus.

Accordingly, it is a primary object of the instant invention to provide an effective apparatus for forming a twisted cord element from an elongated untwisted cord member.

Another object of the instant invention is to provide an effective apparatus for twisting a cord member which is easily operable by a young child.

A further object of the instant invention is to provide a method of twisting an elongated cord member so as to form a permanently twisted cord element.

An even still further object of the instant invention is to provide an effective apparatus for forming twisted cord elements for use in making items of jewelry and the like.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
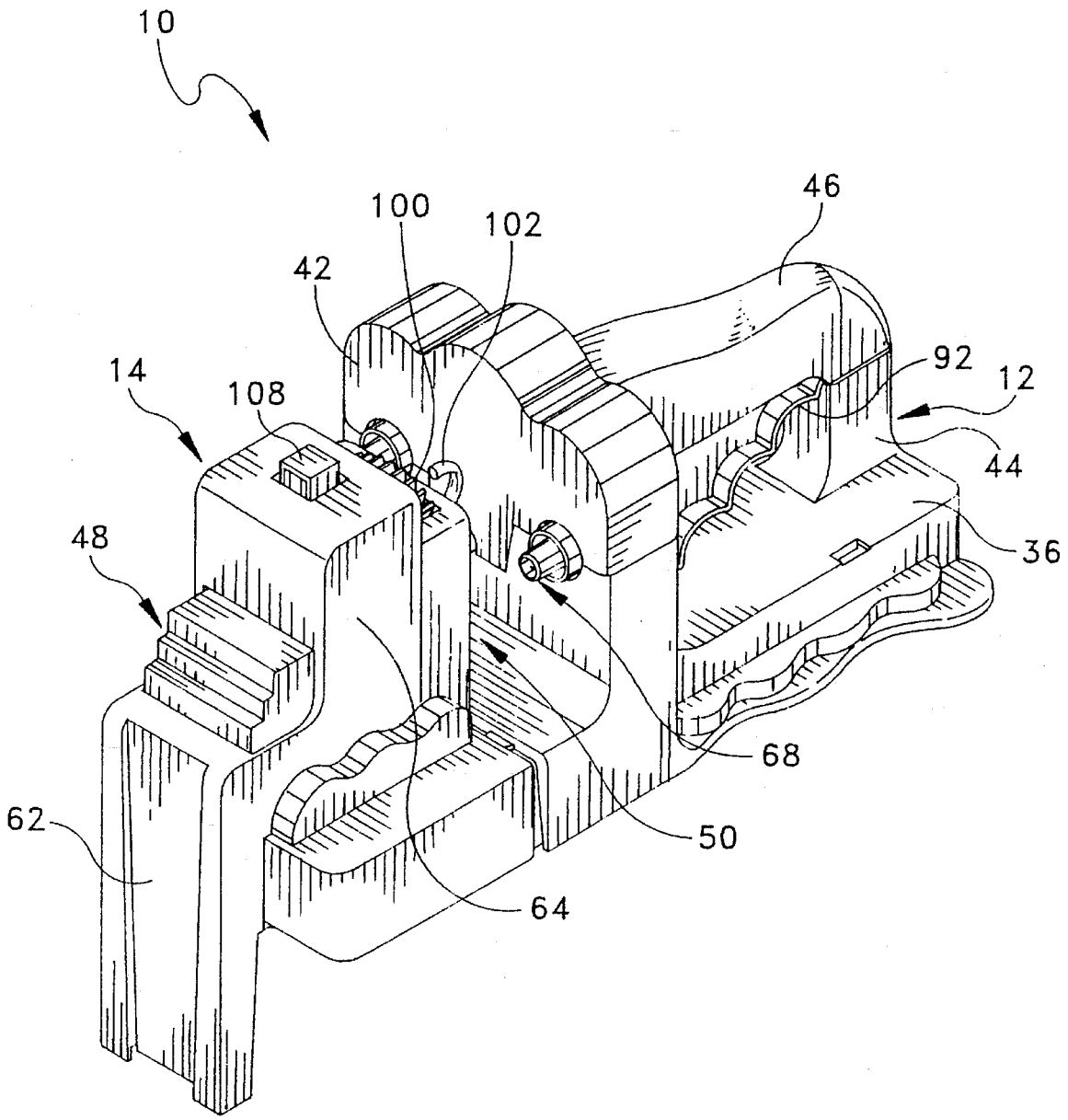
FIG. 1 is a perspective view of the apparatus of the instant invention.
Figure 2:
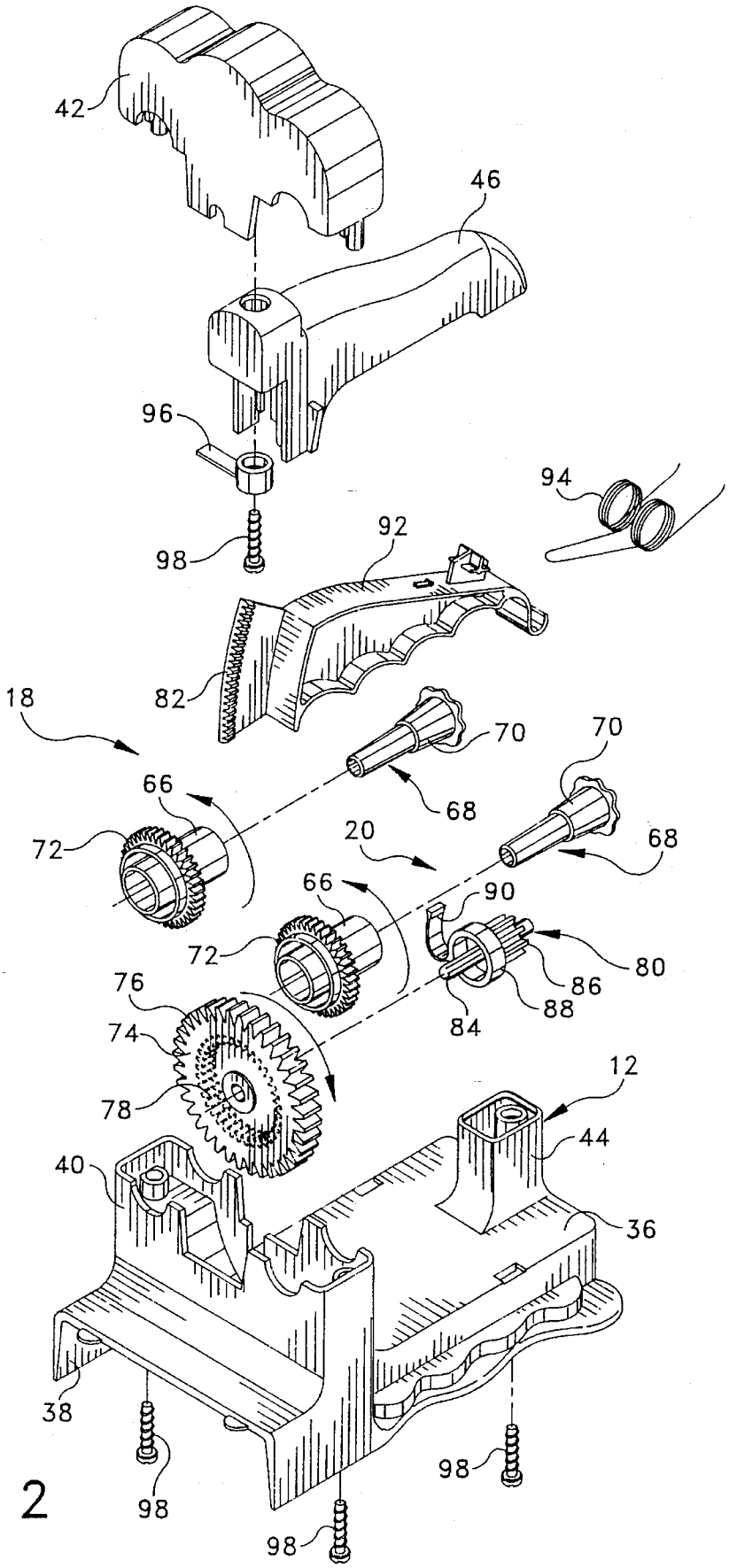
FIG. 2 is an exploded perspective view of the first end unit thereof.
Figure 3:
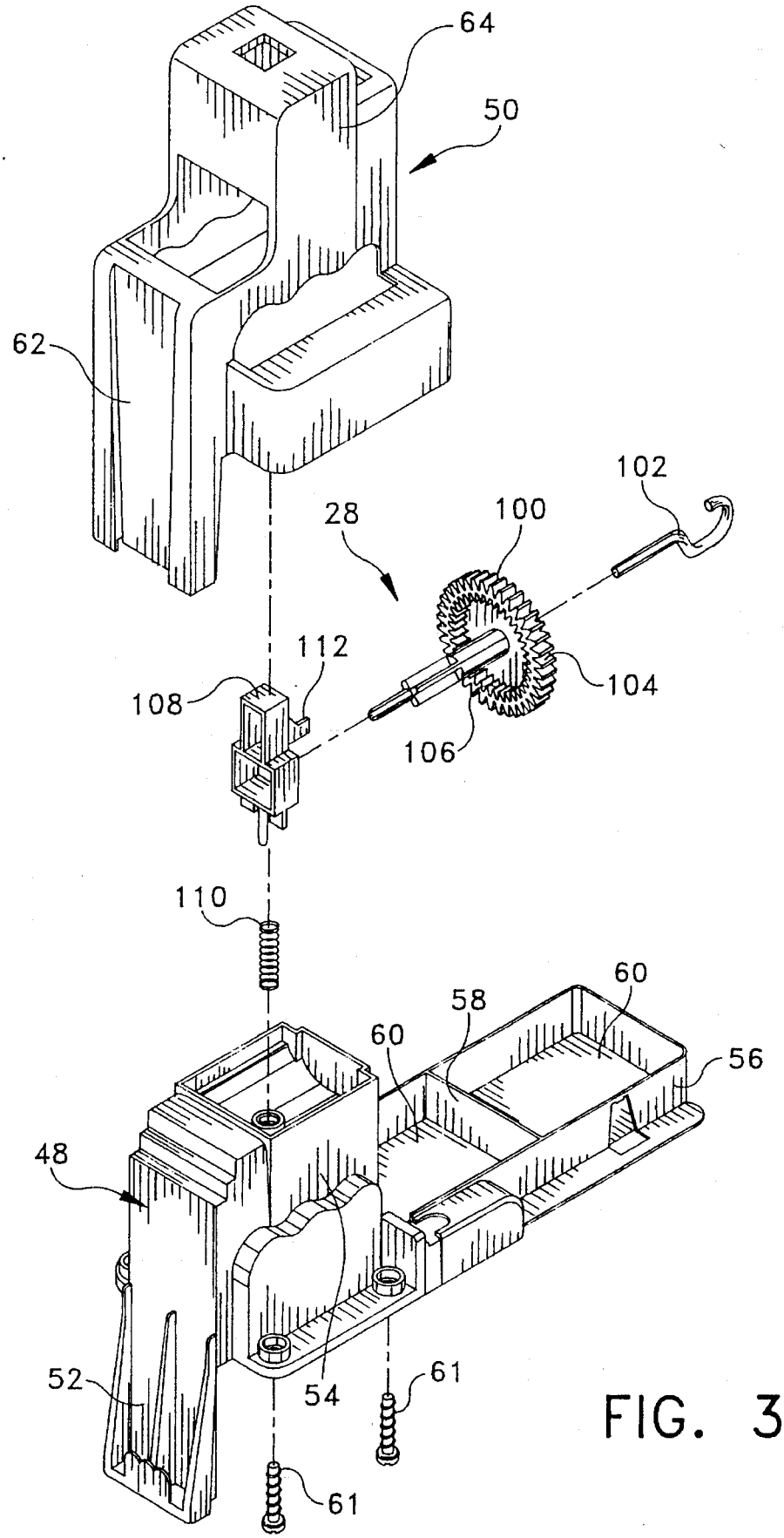
FIG. 3 is an exploded perspective view of the second end unit thereof.
Figure 4:
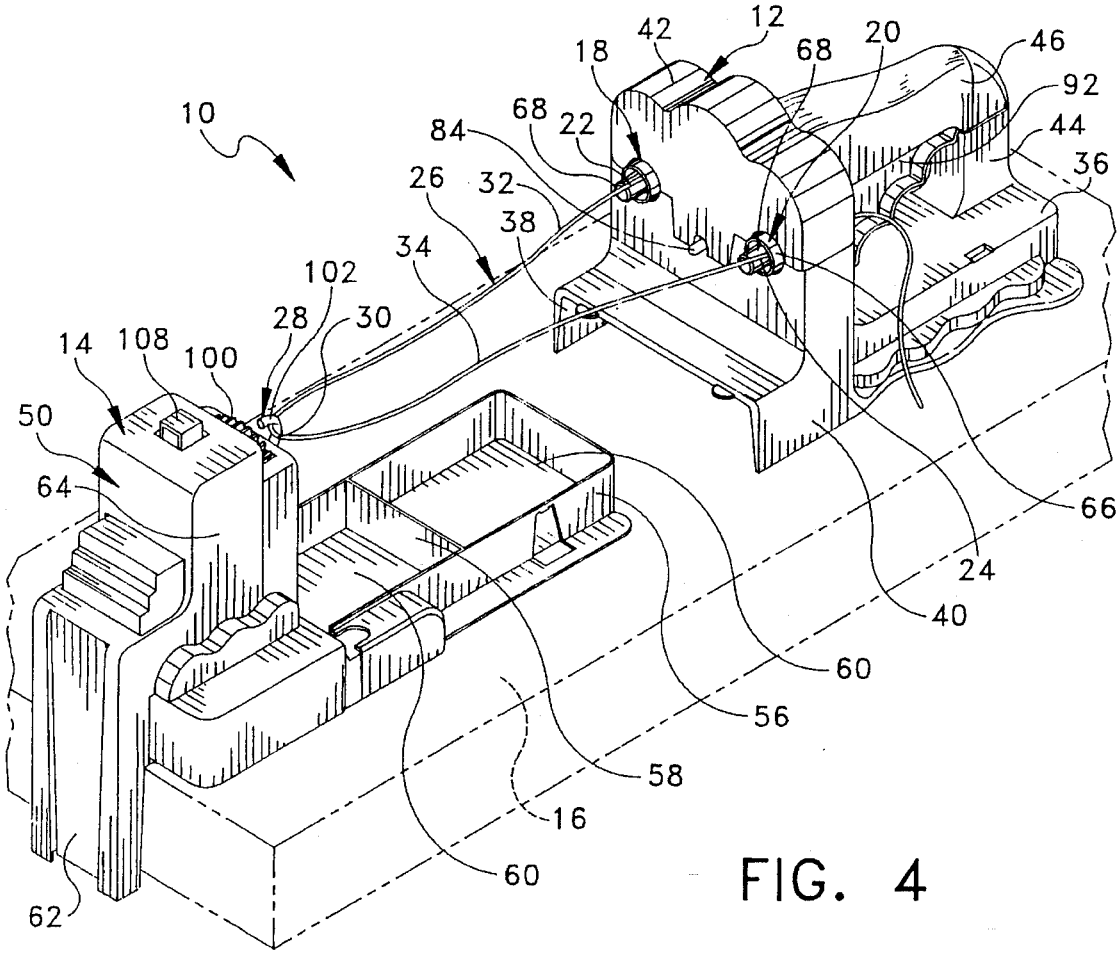
FIG. 4 is a perspective view illustrating the operation of the apparatus.
Figure 5:
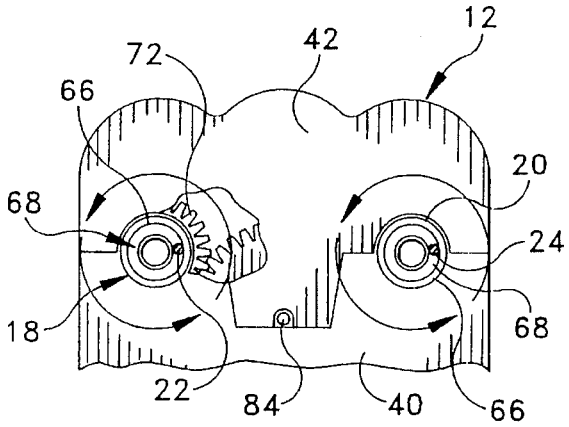
FIG. 5 is a fragmentary front end view of the first end unit with portions of the housing thereof broken away.
Figure 6:
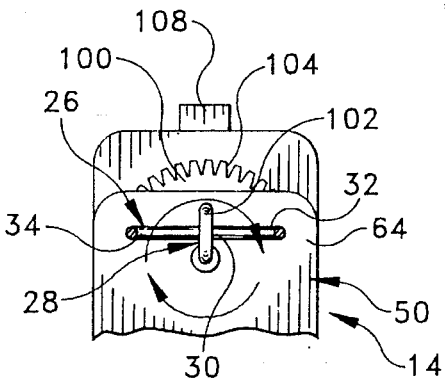
FIG. 6 is a fragmentary front end view of the second end unit.
Figure 7:
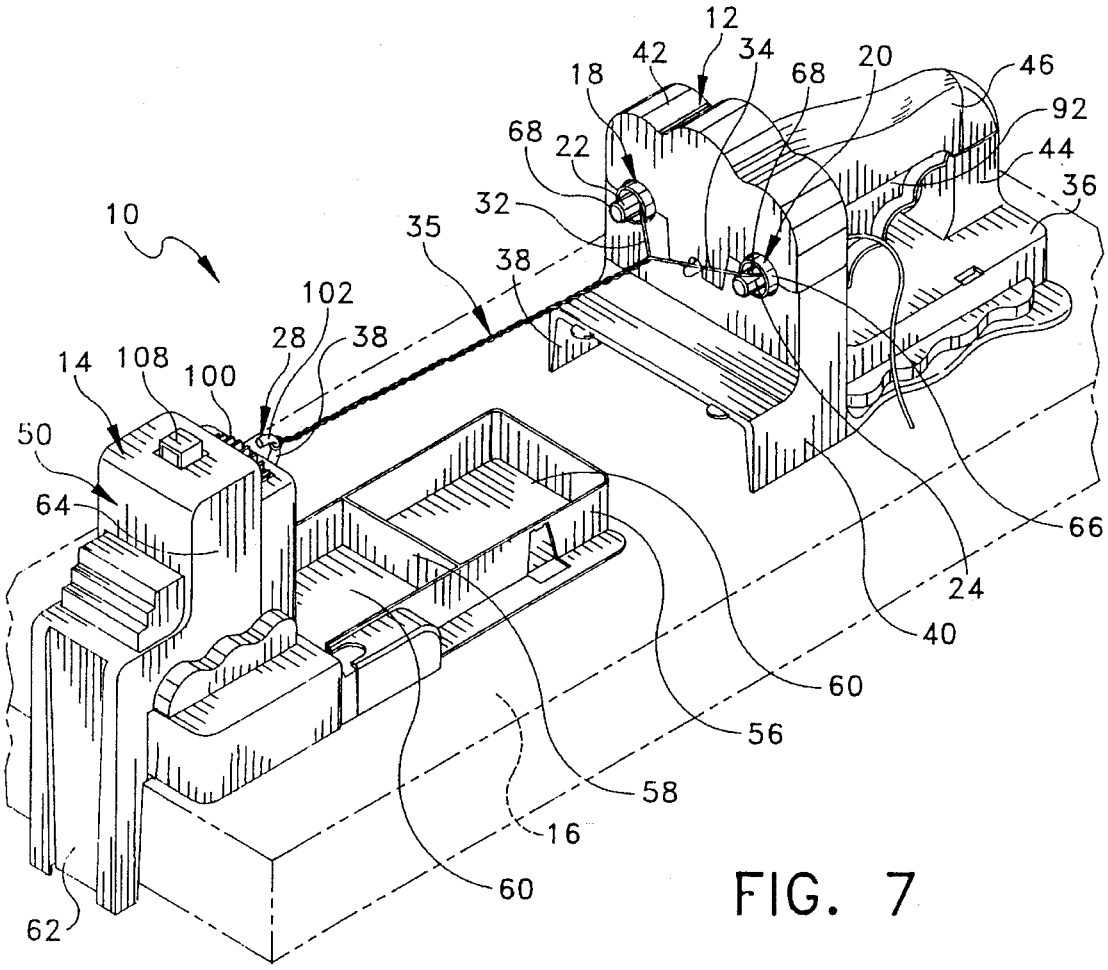
FIG. 7 is a further perspective view illustrating the operation of the apparatus.
Figure 8:
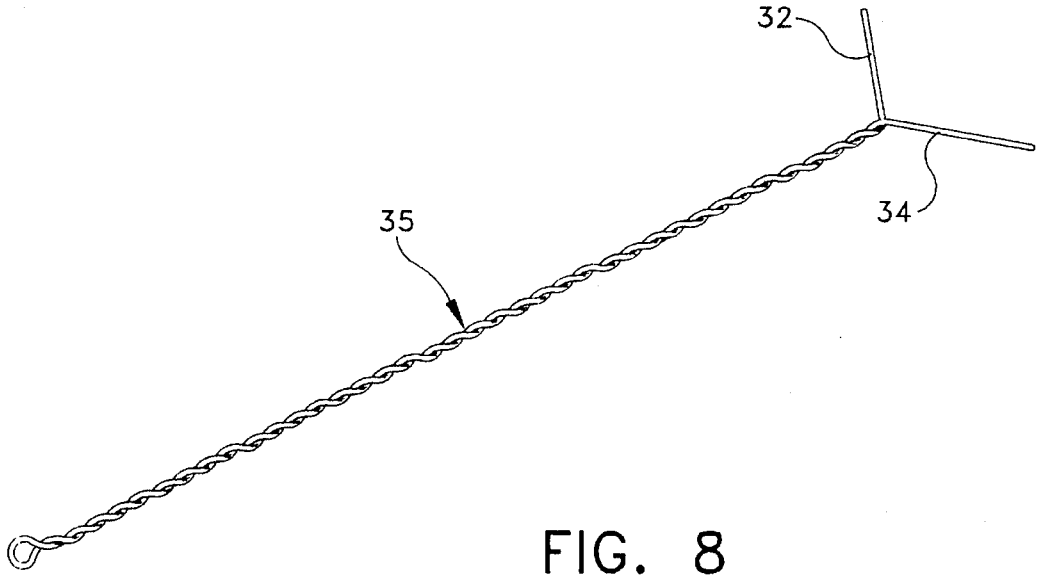
FIG. 8 is a perspective view of a twisted cord element as made with the apparatus.

Referring now to drawings, the apparatus of the instant invention is illustrated in FIGS. 1 through 7 and generally indicated at 10 in FIGS. 1, 4 and 7. The apparatus 10 comprises first and second end units generally indicated at 12 and 14, respectively, which are adapted to be received on a supporting surface as defined by a table top 16. The apparatus 10 further comprises spaced first and second securing and twisting assemblies generally indicated at 18 and 20, respectively, on the first end unit 12 for releasably securing opposite first and second end portions 22 and 24, respectively, of an elongated cord member 26 to the first end unit 12. The apparatus 10 further comprises an intermediate or second end unit securing assembly generally indicated at 28 for releasably securing the cord member 26 to the second end unit 14 at an intermediate point 30 in the extent of the cord member 26. The second end unit securing assembly 28 is operative for defining opposite first and second sections 32 and 34, respectively, of the cord member 26 which include the first and second end portions 22 and 24, respectively, and it is adapted for selectively rotatably on non-rotatably securing the cord member 26 to the second end unit 14. More specifically, the second end unit securing assembly 28 is adapted for securing the intermediate point 30 of the cord member 26 so that it can be retained in non-rotatable relation while the first and second cord member sections 32 and 34, respectively, are axially twisted. The securing assembly 28 is further adapted so that it can thereafter be released to allow the intermediate point 30 to rotate relative to the second end unit 14 so that the first and second cord member sections 32 and 34, respectively, are twisted about one another to form a finished twisted cord element 35 of the type illustrated in FIGS.7 and 8.

The first end unit 12 is adapted to be slidably received on a supporting surface, and it includes a base portion 36 having a downwardly facing open interior cavity 38 formed therein which is adapted for receiving a corresponding section of the second end unit 14, as will hereinafter be more fully set forth. The first end unit 12 further includes a lower gear housing section 40, an upper gear housing section 42, a handle post 44 and an upper handle 46. The gear housing sections 40 and 42 cooperate to provide a housing for the operative components of the first and second twisting assemblies 18 and 20, respectively, and the handle 46 extends between the gear housing sections 40 and 42 and the handle post 44 to provide a convenient stationary operating handle for operating the rotating assemblies 18 and 20, as will hereinafter be more fully set forth.

The second end unit 14 is adapted to be received in a stationary position on the table top 16, and it includes an inner housing portion generally indicated at 48 and an outer housing portion generally indicated at 50. The inner housing portion 48 includes a reinforced, downwardly extending flange portion 52, a main lower housing portion 54 and an elongated outwardly extending tray or tongue portion 56 which is adapted and dimensioned to be slidably received in the cavity 38. The outer housing section 50 is adapted to be received and secured on the lower housing section 48 with screws 61. The outer housing section 50 includes a flange portion 62 and a main housing section 64. The flange portion 62 is adapted so that it cooperates with the flange portion 52 for providing a flange assembly which is engagable with an edge of the table top 16 in the manner illustrated in FIG. 4 for retaining the second end unit 14 in position thereon. The main outer housing section 64 is adapted so that it cooperates with the main inner housing section 54 to define a housing for receiving and containing the operative components of the second end unit assembly 28 as illustrated most clearly in FIG. 3.

The first and second end portion securing and twisting assemblies 18 and 20, respectively, are formed as a single assembly which includes a pair of tubular elements 66 for receiving the opposite end portions 22 and 24, respectively, of the cord member 26 therethrough, and a pair of plugs 68 having knurled, tapered portions 70 which are receivable in the tubular elements 66 for capturing the opposite end portions 22 and 24, respectively, therein. The composite assembly comprising the twisting assemblies 18 and 20, respectively, further includes a pair of spool gears 72 which are integrally formed with the tubular elements 66, a floating gear 74 having both an external gear face 76 and an inwardly facing internal gear face 78 thereon, a ratchet element generally indicated at 80 and a rack gear 82. The ratchet element 80 includes a shaft 84 which is received through the floating gear 74 and rotatably mounted in the first end unit 12. Also included in the ratchet element 80 is a ratchet gear 86, a ratchet ring 88 and a resilient ratchet arm 90 which extends outwardly from the ratchet ring 88. The ratchet element 80 is received in engagement with the floating gear 74 so that the ratchet ring 88 is received in the open interior area defined by the interior gear face 78 and so that the resilient ratchet arm 90 engages the gear face 78. The ratchet arm 90 is adapted so that it is operative for rotating the floating gear 74 in a clockwise direction only, i.e. so that the arm 90 passes over the teeth 78 when the ratchet element 80 is rotated in a counter-clockwise direction. The spool gears 72 and the tubular elements 66 are rotatably mounted in the end unit 12 so that the spool gears 72 intermesh with the outer gear face 76 on the floating gear 74. Accordingly, the spool gears 72 and the tubular elements 66 rotate in counter-clockwise directions when the floating gear 74 is rotated in a clockwise direction by the ratchet element 80. The rack gear 82 is integrally formed with a pivoting handle element 92 which is pivotally mounted in the handle element 46. A spring 94 biases the handle element 92 to a downward position, and the handle element 92 is positioned in the end unit 12 so that the rack gear 82 engages the ratchet gear 86 in order to rotate the ratchet gear 86 as the handle element 92 is pivoted upwardly or downwardly. However, because the ratchet gear 86 communicates with the floating gear 74 through the ratchet arm 90, the rack gear 82 only operates to drive the floating gear 74 when the handle element 92 is pivoted upwardly. To further assure that this is the case and that the spool gear 72 and the floating gear 74 are each only rotatable in a single direction, a resilient pawl element 96 is provided, the pawl element 96 being positioned so that it engages the gear face on one of the spool gears 72 to prevent rotation thereof in a clockwise direction. The pawl element 96 is secured in the upper housing section 42 with a screw 98, and a plurality of additional screws 98 are provided for retaining the first end unit 12 in assembled relation so that the securing and twisting assemblies 18 and 20 are retained in assembled positions.

The intermediate or second end unit securing assembly 28 is mounted in the second end unit 14, and it comprises a gear 100 having a hook element 102 non-rotatably secured thereto so that the shank portion of the hook element 102 is axially aligned with the gear element 100. The gear element 100 includes an outer gear face 104 and an inner gear face 106, and it is mounted in the second end unit 14 so that the outer gear face 104 is partially exposed, as illustrated most clearly in FIG. 6, to enable the gear element 100 and the hook element 102 to be manually rotated when desired. Also included in the second end unit securing assembly 28 is a locking button 108 which is biased to an upward position with a spring 110. The button 108 has a blade 112 thereon which is engageable with the upwardly disposed portion of the inner gear face 106 to prevent rotation of the gear 104. The button 108 extends upwardly through an opening in the outer housing section 50 so that it is depressible for disengaging the blade 112 from the inner gear face 106 to enable the gear 100 and the hook element 102 to rotate.

Accordingly, for use in operation of the apparatus 10 the second end unit 14 is positioned so that the flange portions 52 and 62 extend downwardly along one end of the supporting surface 16 and so that the first end unit 12 faces the second end unit 14 in the manner illustrated in FIGS. 1, 4 and 7. The cord member 26 is then assembled with the first end unit 12 so that the opposite end portions 22 and 24 are received in their respective tubular elements 66, and the plug elements 68 are assembled in the tubular element 66 to secure the opposite end portions 22 and 24 therein. The cord member 26 is then looped over the hook 102 so as to define opposite portions 32 and 34 of the cord member 26 of substantial equal length. The first end unit 12 is then positioned so that the cord element 26 is in a substantially taut condition, and the pivoting handle element 92 is drawn upwardly in a trigger-like manner. This causes the rack gear 82 to rotate the ratchet gear 86 which in turn causes the ratchet element 90 to rotate the floating gear 74 in a clockwise direction. As the floating gear 74 is rotated, the spool gears 72 are rotated in counter-clockwise directions, and the pawl element 96 rides on one of the spool gears 72 to prevent the gears 72 and 74 from rotating in reverse directions. As the pivoting handle element 92 is released, the spring 94 returns it to a downward position, and the ratchet element 90 travels over the inner gear face 78. Further, as the spool gears 72 are rotated, the tubular elements 66 are rotated to axially rotate the opposite end portions 22 and 24 of the cord member 26. As the opposite portions 32 and 34 of the cord member 26 are twisted in this manner, the hook element 102 is retained in a stationary or non-rotatable position so that the opposite portions 32 and 34 can be effectively twisted. Once the opposite portions 32 and 34 have been twisted to an appreciable extent, the button 108 can be depressed to disengage the blade element 112 from the gear face 106. This allows the hook element 102 to be rotated by the twisted cord member sections 32 and 34 so that the twisted cord member sections 32 and 34 are twisted about one another to form a finished twisted cord element 35. Thereafter, the plugs 68 can be removed from the tubular elements 66 to disengage the end portions 22 and 24 from the attaching assemblies 18 and 20, and the finished twisted cord element 35 can also be disengaged from the hook element 102. The free-end portions 22 and 24 are preferably thereafter secured together to prevent the twisted cord element 35 from unraveling. However, because of the manner in which the twisting operation is carried out the finished twisted cord element 35 is not automatically biased to an unraveled position so that the opposite end portions 22 and 24 can be easily manipulated to secure them together to retain the twisted cord element 35 illustrated in FIG. 8 in a twisted disposition.

As an alternative to the above, it is also possible to utilize a plurality of separate strands to define the cord member 26, and in this case the opposite end portions of each strand are secured to the securing and twisting assemblies 18 and 20 and the intermediate point 30 is secured to securing assembly 28. It is also possible to assembly one or more beads or the like on the cord member 26 before it is twisted with the apparatus 10 so that the beads become an integral part of the finished twisted cord element. In any case, the apparatus 10 is operative in a simple and easy manner for carrying out a twisting operation so that the apparatus 10 can be effectively operated by even a young child.

It is seen therefore, that the instant invention provides an effective apparatus for twisting an elongated cord member to form a permanently twisted cord element 35. The apparatus 10 is adapted to be simply and easily operated by a young child, and it can be effectively operated for forming twisted cord elements 35 of various different sizes, lengths and types. Hence, it is seen that the apparatus 10 represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A method of forming a twisted cord element from an elongated cord member having opposite first and second end portions comprising;

securing said cord member at an intermediate point between said first and second end portions so as to define opposite first and second sections of said cord member which include said first and second end portions, respectively, and so as to releasably secure said intermediate point in non-rotatable relation;

assembling at least one bead element on at least one of said cord member sections;

axially twisting said first and second sections of said cord member in the same direction of rotation while maintaining said first and second sections of said cord member in spaced relation and under slight tension; and allowing said intermediate point to rotate to allow said first and second sections of said cord member to twist about one another to form said twisted cord element with said bead element captured between portions of said first and second cord member sections.

* * * * *